US008005390B2

(12) United States Patent
Ramesh et al.

(10) Patent No.: US 8,005,390 B2
(45) Date of Patent: Aug. 23, 2011

(54) OPTIMIZATION OF RELOAD PERFORMANCE FOR PRINTER DEVELOPMENT SYSTEMS WITH DONOR ROLLS

(75) Inventors: Palghat S. Ramesh, Pittsford, NY (US); Joseph Sheflin, Macedon, NY (US); Jack LeStrange, Macedon, NY (US); Peter Paul, Webster, NY (US); Aaron M. Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 387 days.

(21) Appl. No.: 12/250,591

(22) Filed: Oct. 15, 2008

(65) Prior Publication Data

US 2010/0092200 A1 Apr. 15, 2010

(51) Int. Cl.
*G03G 15/00* (2006.01)
*G03G 15/02* (2006.01)

(52) U.S. Cl. ..... 399/72; 399/49; 399/50; 399/31

(58) Field of Classification Search ..... 399/72
See application file for complete search history.

(56) References Cited

U.S. PATENT DOCUMENTS

| | | | | |
|---|---|---|---|---|
| 5,450,165 | A * | 9/1995 | Henderson | 399/49 |
| 5,887,221 | A * | 3/1999 | Grace | 399/49 |
| 5,887,223 | A * | 3/1999 | Sakai et al. | 399/60 |
| 6,032,004 | A | 2/2000 | Mirabella, Jr. et al. | |
| 6,185,385 | B1 * | 2/2001 | Mestha et al. | 399/49 |
| 6,198,886 | B1 * | 3/2001 | Brewington | 399/49 |
| 6,816,687 | B1 | 11/2004 | Dalal et al. | |
| 6,842,590 | B2 | 1/2005 | Dalal et al. | |
| 7,013,094 | B2 | 3/2006 | Dalal et al. | |
| 7,263,301 | B2 * | 8/2007 | Martin et al. | 399/27 |
| 7,295,340 | B2 | 11/2007 | Mestha et al. | |
| 7,616,909 | B2 * | 11/2009 | Kato et al. | 399/49 |
| 2004/0136013 | A1 * | 7/2004 | Mestha et al. | 358/1.9 |
| 2004/0240901 | A1 * | 12/2004 | Dalal et al. | 399/49 |
| 2004/0240902 | A1 * | 12/2004 | Dalal et al. | 399/49 |
| 2005/0169651 | A1 * | 8/2005 | Yamada | 399/49 |
| 2006/0285863 | A1 * | 12/2006 | Noguchi et al. | 399/49 |
| 2007/0003303 | A1 * | 1/2007 | Burry et al. | 399/53 |
| 2007/0092274 | A1 * | 4/2007 | Ramesh et al. | 399/49 |
| 2008/0144067 | A1 * | 6/2008 | Burry et al. | 358/1.13 |

* cited by examiner

*Primary Examiner* — David Gray
*Assistant Examiner* — David Bolduc
(74) *Attorney, Agent, or Firm* — Gibb I.P. Law Firm, LLC

(57) ABSTRACT

A method creates a printing image charge on a photoreceptor printing region of a photoreceptor within a printing apparatus and, simultaneously with the creating of the printing image charge, charges source patches on the photoreceptor outside the photoreceptor printing region. The method then transfers developer material from a donor roll to the photoreceptor. The source patches cause developer material to be removed from areas of the donor roll outside a donor roll printing region to create developer material-depleted regions. The method then reloads the donor roll with developer material using a magnetic brush and evaluates a reload function of the donor roll by characteristics of developer material on target patches with developer material in areas of the non-printing region of the photoreceptor adjacent the target patches. The method then alters the printing image charge to maintain the reload function within a predetermined range.

20 Claims, 12 Drawing Sheets

OPTIMIZATION OF RELOAD PERFORMANCE FOR PRINTER DEVELOPMENT SYSTEMS WITH DONOR ROLLS

BACKGROUND AND SUMMARY

Embodiments herein generally relate to electrostatographic printers and copiers or reproduction machines, and more particularly, concern a printing method that constantly monitors the reload function of a developer donor roll to avoid the formation of ghost images on the printed product.

Some systems use a two component magnetic brush to load toner onto a donor roll, which delivers the toner to the image on the photoreceptor. After the toner is stripped from the donor rolls and delivered to the image, the donor roll reloads toner from the magnetic brush. However, the properties of the toner (mass, charge, size) in these reloaded areas are different from the non-reloaded areas. This leads to an image defect in the form of a ghost of the previous image at a distance of one or more donor revolutions. This image quality artifact is commonly referred to as the "Reload Defect." Reload defects are also observed in single component development systems.

Development hardware and materials are optimized to address reload. Reload efficiency is a strong function of toner supply to the donor loading nip. The toner supply is increased by increasing the speed of the magnetic roll and increasing the developer packing fraction in the donor loading nip. However, both approaches increase the rate of developer material abuse and impact the overall developer material life. It has been observed that rotating the donor rolls in a direction against the magnetic roll improves reload. However, it has also been observed that the opposite surface movement mode loading leads to higher levels of mottle on the prints (lack of smoothness in halftone areas). In fact, most of the counter measures for good reload (opposite surface movement mode loading, high toner concentration (TC), conductive developer, alternating current (AC) bias in the loading nip) result in higher levels of mottle on the prints. Reducing reload using other means can open opportunities for optimizing the developer system design and material design to address image noise and life.

Reload efficiency is a function of the developer material state and environment and can vary over time and from one print job to the next. Reload efficiency can vary in the cross process direction due to inboard to outboard variation in TC, developer material flow and developer gap.

Exemplary embodiments herein create a latent printing image charge (that could be part of a print job) on a photoreceptor printing region of a photoreceptor within a printing apparatus. Either as a calibration operation, or simultaneously with the print job, the embodiments herein charge latent images of source patches on a printing region of the photoreceptor in the case of a calibration operation or a non-printing region of the photoreceptor outside the photoreceptor printing region in the case of a continuous monitoring operation.

The embodiments herein transfer marking material (e.g, toner, ink, etc.) from a donor roll to the photoreceptor by rotating the donor roll as the photoreceptor passes by the donor roll. The source patches cause marking material to be removed from areas of the donor roll to create marking material-depleted regions corresponding to the source patches. The marking material-depleted regions are reloaded with marking material using a magnetic brush.

After reloading the marking material-depleted regions with marking material (and simultaneously with the continuous creation of the printing image charge in continuous monitoring mode) the embodiments herein charge latent images of reload target patches and ideal target patches on the non-printing region of the photoreceptor. The reload target patches are located one donor roll rotation distance (equal to the circumference of the donor roll) on the photoreceptor from the source patches. The ideal target patches are located on the photoreceptor between the reload target patches. The reload (depleted) target patches and ideal target patches should be of the same area coverage (or color) so that any differences between them are only due the reload function.

The embodiments herein continue to transfer the marking material from the donor roll to the photoreceptor. This continuing process transfers the marking material to the reload target patches and the ideal target patches on the photoreceptor. Note that because the marking material-depleted regions were previously reloaded and because the reload target patches are spaced one donor roll rotation distance from the source patches, the reload target patches draw marking material that has been reloaded on the marking material-depleted regions of the donor roll. To the contrary, the ideal target patches draw marking material from regions of the donor roll between the marking material-depleted regions and, therefore, draw marking material from regions of the donor roll that have passed by the magnetic brush multiple times. The ideal target patches therefore draw marking material from regions of the donor roll that could be considered to be fully reloaded (or ideally reloaded).

After transferring the marking material to the reload target patches and the ideal target patches on the photoreceptor, the embodiments herein evaluate the reload function of the donor roll and the magnetic brush by comparing characteristics of the marking material on the reload target patches with marking material on the ideal target patches. This allows the embodiments herein to alter the printing image charge to maintain the reload function within a predetermined range.

This method constantly monitors the reload function of the developer material donor roll while the print job is printing to avoid the formation of ghost images on the printed product. Initial evaluation of the reload function may occur when the printing apparatus cycles up to print a print job. However, the subsequent "evaluation" and "correction" of the of the reload function and the "altering" of the printing image charge occur simultaneously with the printing apparatus printing one or more print jobs, and the evaluating and the altering processes avoids interrupting the print jobs.

The predetermined range of the reload function prevents ghost images from being perceptible within printed sheets produced by the printing apparatus. The method alters the printing charge to maintain the reload function within the predetermined range, yet avoids altering the relative rotational speeds of the donor roll and the magnetic brush, the packing fraction of developer material, and/or the developer material concentration. In other words, in some embodiments, the method alters only the printing charge to maintain the reload function within the predetermined range, which is substantially more efficient than methods that alter such aspects regarding the physical loading of developer material on the donor roll.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Reload defects are a significant problem in hybrid development systems. The defect occurs when toner removed from a donor roll to an image on the photoreceptor is incompletely replenished by a magnetic brush during the subsequent pass. The resulting differences in toner properties in the reloaded region versus the fully loaded regions manifest themselves as a ghost of the previous image which is most easily visible on a uniform halftone region. The distance of the reload defect (i.e. ghost) from the original image is given by $\pi D_d U_{pr}/U_d$ and is referred to as the reload distance D, where $D_d$ is the donor diameter, $U_{pr}$ is the photoreceptor speed and $U_d$ is the donor speed.

Reload calibration target sheets can be printed during cycle up and measured using a sensor or scanner to obtain a reload model prior to starting a print job, or the print job can be interrupted to calibrate the reload function. Thus, the reload information can be periodically updated by printing additional reload calibration targets during the customer job, but at the price of reduced productivity to the customer. Therefore, some embodiments herein use the extra space outside of the customer image area to continually monitor the print engine's reload performance during the customer print job. As described below, reload source and reload target patches are printed outside of the customer image zone and are used to continually monitor the reload defect during the customer print job. The measurements from the patches are used to obtain or update a reload model and adjust the contone level of the input image to compensate for reload defects. Alternately, the reload measurements can be used to adjust developer setpoints for optimal tradeoff between reload, mottle and developer life. Colors for the reload source and target patches may be chosen from the customer image colors for accurate evaluation of reload on the customer image.

Figure 1:
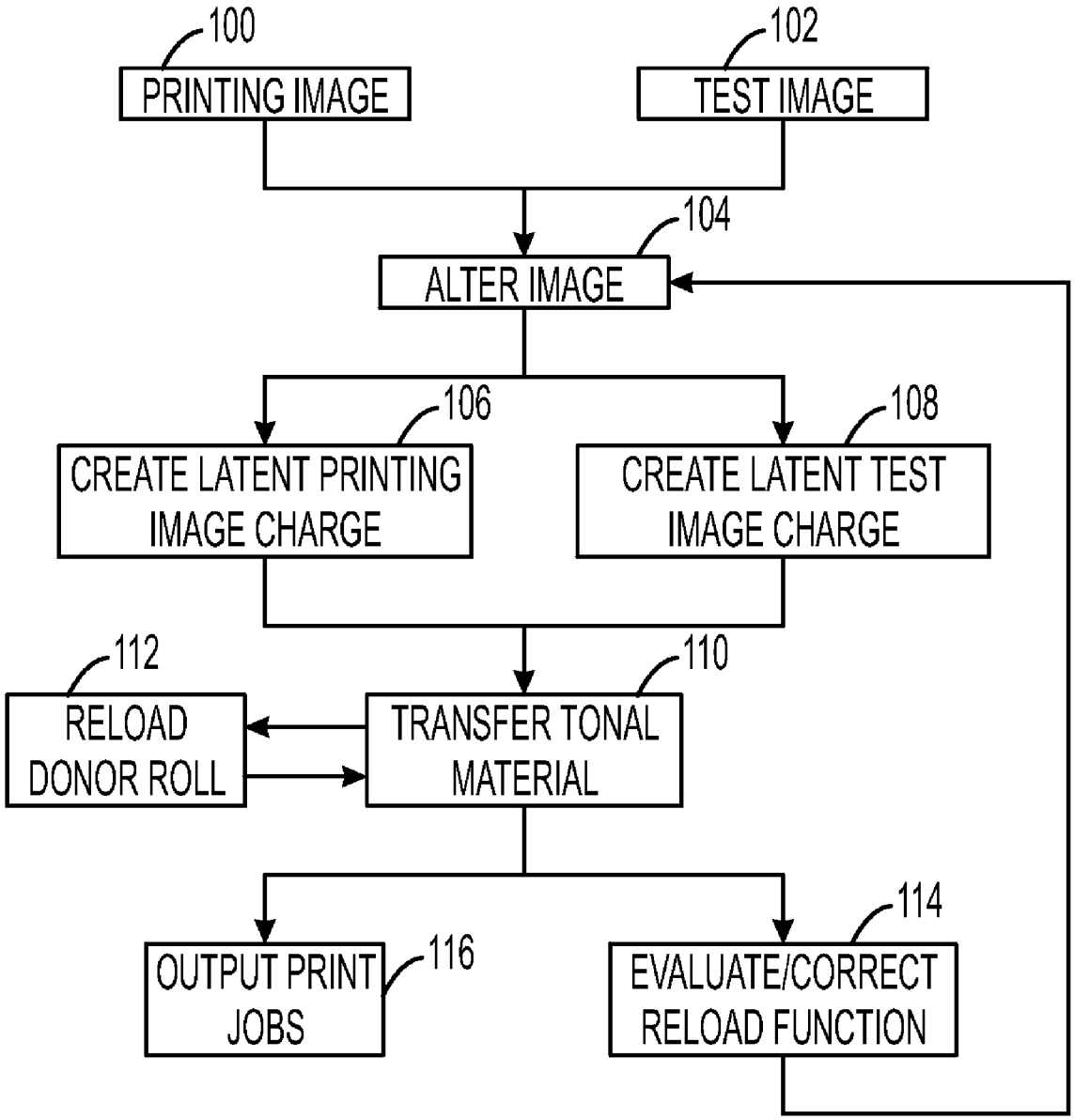
FIG. 1 is a flow diagram illustrating method embodiments herein.

As shown in flowchart form in FIG. 1, one exemplary method embodiment herein uses the printing image in item 100 and a reload model in item 114 to create an altered printing image in item 104. The altered printing image is used to create a latent printing image charge on a photoreceptor printing region of a photoreceptor within a printing apparatus in item 106. A customer print job or a standard calibration target (that is dependent upon a customer image) could appear in the photoreceptor printing region. Simultaneously while creating the latent printing image charge, the method also creates a latent test image charge of a test image 102 on the photoreceptor outside the photoreceptor printing region as shown in item 108. The toner material is transferred from a donor roll to a photoreceptor in item 110 to develop both the latent printing image charge from item 106 and latent test image charge from item 108. The toner material removed from the donor roll is reloaded from the magnetic roll in item 112. The developed test image on the photoreceptor is used to evaluate and/or correct a reload function in item 114. The developed printing image is transferred to paper and fused to create the output print job in item 116.

Figure 2:
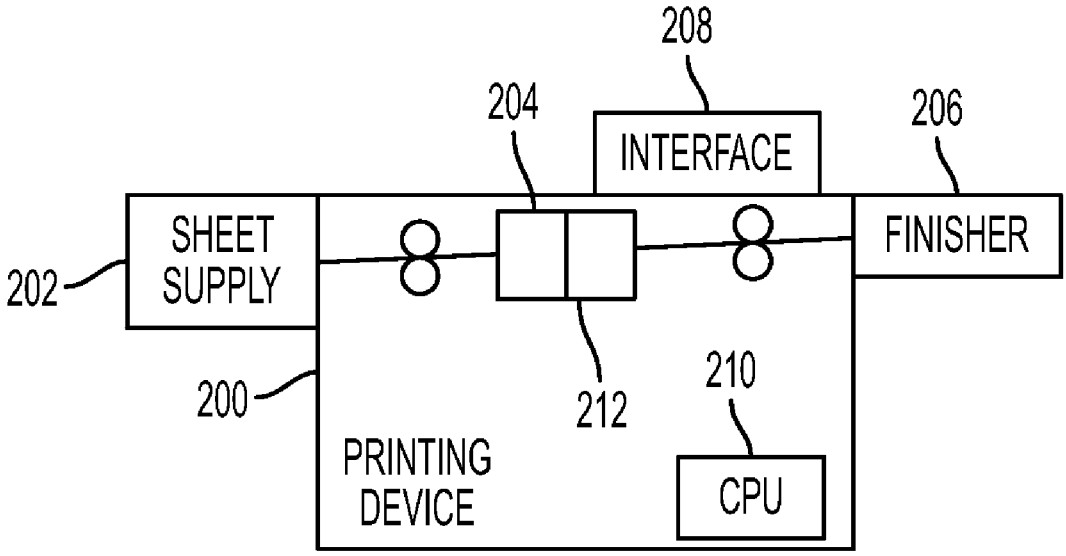
FIG. 2 is a cross-sectional schematic diagram of a printing device according to embodiments herein.

One exemplary structure that can be used with the embodiments herein is shown generally in FIGS. 2-6. FIG. 2 illustrates a printing device 200 that includes a media supply 202 that feeds sheets of media along various marking devices 204 (printing engines having raster image scanners, photoreceptors, donor rolls, etc.) which create markings on the media sheets. A sensor 212 can be used to observe the photoreceptor, as described below. A finisher 206 can be utilized to perform such operations as folding, stabling, bookmaking, etc. Such a printing device could include a processor and a computer storage media operatively connected to the processor (the computer storage media stores instructions executable by the processor) which are represented by item 210 in FIG. 2. The printing device could also include an interface 208 operatively connected to the processor 210 that could comprise a graphic user interface and/or an interface to a network, telephone connection, Internet connection, etc.

Figure 3:
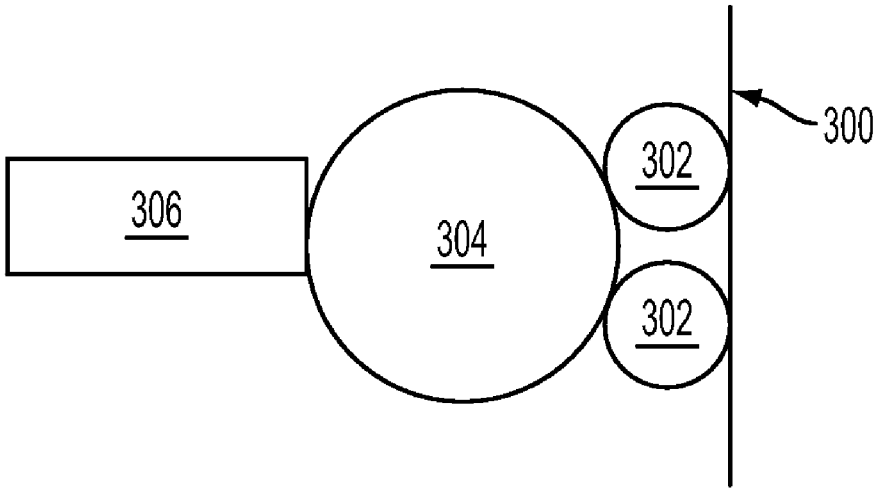
FIG. 3 is a cross-sectional schematic diagram of donor rolls according to embodiments herein.
Figure 4:
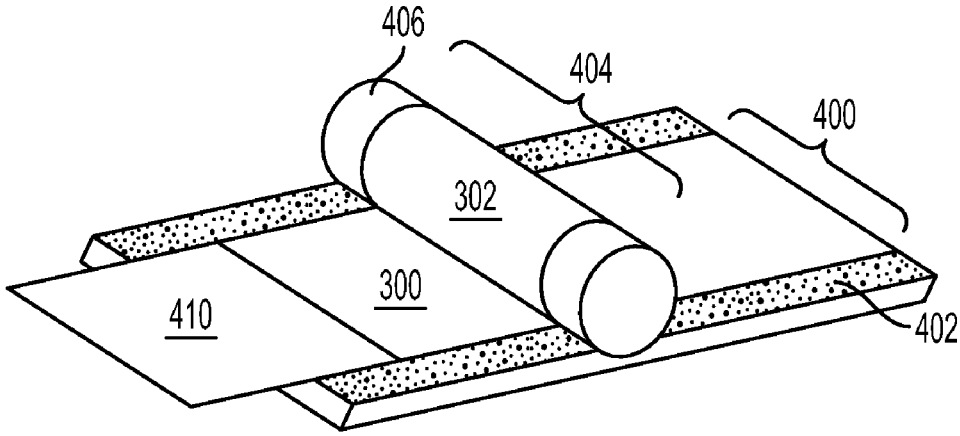
FIG. 4 is a perspective view schematic diagram of a photoreceptor and donor roll according to embodiments herein.

FIG. 3 illustrates one aspect of one of the marking devices 204 where donor rolls 302 contact a photoreceptor 300 (such as a belt or drum) in order to transfer toner material (e.g., developer material, such as toner, inks, marking materials, etc.) from the donor rolls 302 to the discharged regions of the photoreceptor 300. A magnetic brush 304 reloads toner material onto the donor rolls 302 by drawing toner material from a toner material supply 306 that stores a quantity of toner material. The device can include multiple donor rolls 302, as shown in FIG. 3, or a single donor roll 302 as shown in FIG. 4. If multiple donor rolls 302 are used, the donor rolls 302 can be run at slightly different speeds so that the reload due to the two rolls do not overlap.

FIG. 4 illustrates a perspective-view of the photoreceptor 300 and a perspective-view of one of the donor rolls 302. In these drawings, the areas of the photoreceptor 300 that will transfer an image to a sheet of media 410 are referred to as the photoreceptor printing region 400. The portions of the photoreceptor 300 that are outside this photoreceptor printing region 400 are identified by number 402. These areas 402 can be termed non-printing regions because they are not used to print to media sheets.

Similarly, the areas of the donor roll that will transfer developer material to the photoreceptor printing region are referred to as the donor roll printing region 404. The portions of the donor roll 302 that are outside this donor roll printing region 404 are identified by number 406 (and can similarly be termed non-printing regions). The donor roll printing region 404 corresponds to, and transfers toner material to, the photoreceptor printing region 400 of the photoreceptor 300.

Figure 5:
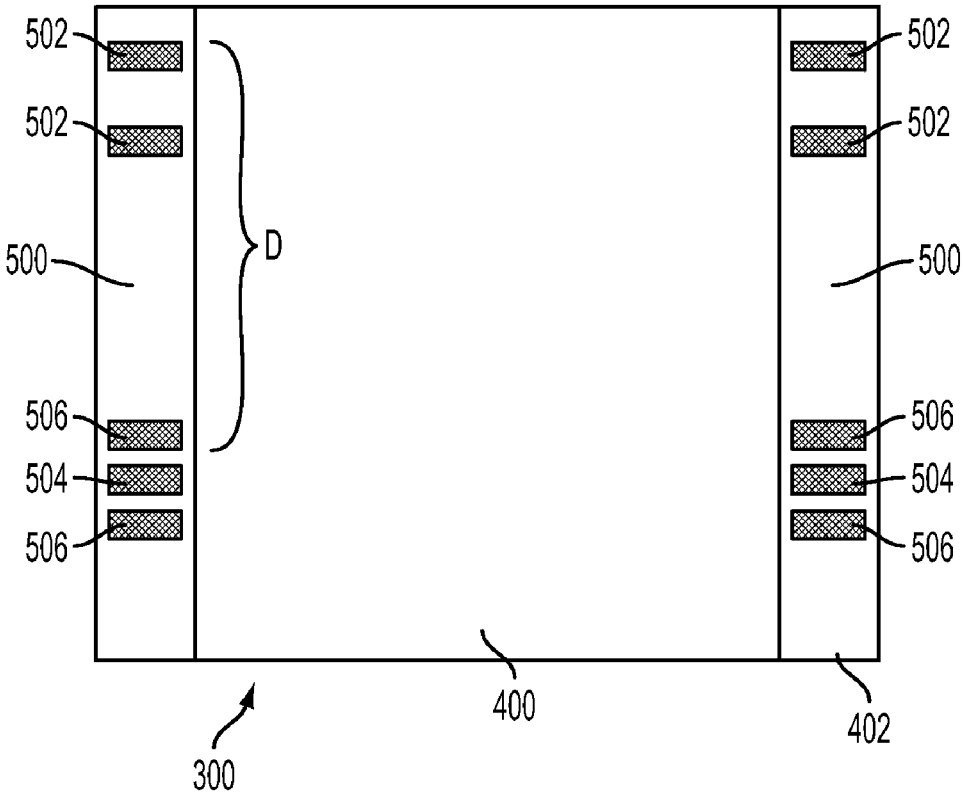
FIG. 5 is a top-view schematic diagram of a photoreceptor according to embodiments herein.

As mentioned above, exemplary embodiments herein can create a latent printing image charge (that is part of a print job) on a photoreceptor printing region 400 of a photoreceptor 300 within a printing apparatus. As shown in FIG. 5, either as a calibration operation, or simultaneously with the print job, the embodiments herein charge latent images of source patches 502 on a non-printing region 402 of the photoreceptor 300 outside the photoreceptor printing region 400.

Figure 6:
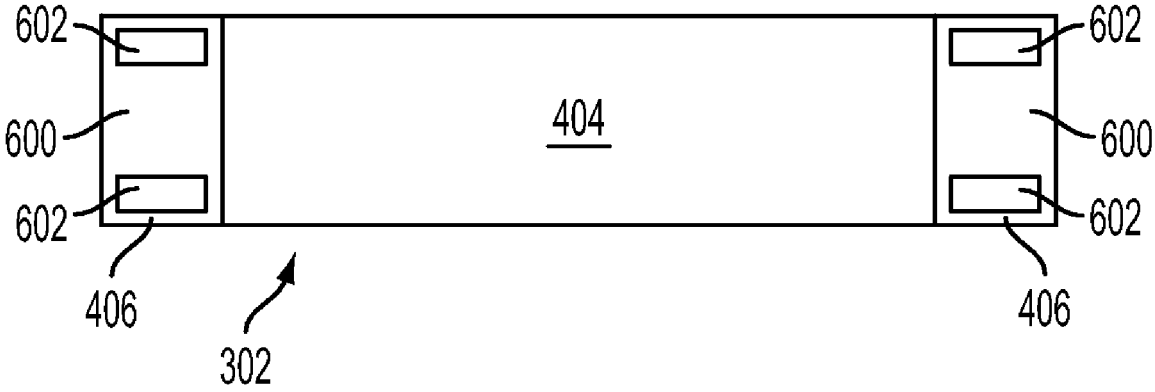
FIG. 6 is a top-view schematic diagram of a donor roll according to embodiments herein.

The embodiments herein transfer marking material from the donor roll 302 to the photoreceptor 300 by rotating the donor roll 302 as the photoreceptor passes by the donor roll. As shown in FIG. 6, the source patches 502 cause marking material to be removed from areas 406 of the donor roll 302 outside a donor roll printing region 404 to create marking material-depleted regions 602 corresponding to the source patches 502. The marking material-depleted regions 602 are reloaded with marking material (e.g., toner, ink, etc.) using the magnetic brush 304.

After reloading the marking material-depleted regions 602 with marking material (and simultaneously with the continuous creation of the printing image charge on the photoreceptor 300 in non-calibration mode) the embodiments herein charge latent images of reload target patches 506 and ideal target patches 504 on the non-printing region 402 of the photoreceptor 300. The reload target patches 506 are located one donor roll rotation distance D (the circumference of the donor roll multiplied by the ratio of the photoreceptor to donor roll speed) on the photoreceptor 300 from the source patches 502. The ideal target patches 504 are located on the photoreceptor 300 between the reload target patches 506. The reload (depleted) target patches and ideal target patches should be of the same area coverage (or color) so that any differences between them are only due the reload function.

Note that while only a limited number of source and target patches are illustrated in the drawings, one ordinarily skilled in the art would understand that many such patches could be used with embodiments herein and these embodiments are not limited to the size, number, shape, and area coverage etc., of the patches shown in the drawings.

The embodiments herein continue to transfer the marking material from the donor roll 302 to the photoreceptor 300. This continuing process transfers the marking material to the reload target patches 506 and the ideal target patches 504 on the photoreceptor 300.

Note that because the marking material-depleted regions 602 were previously reloaded and because the reload target patches 506 are spaced one donor roll rotation distance D from the source patches 502, the reload target patches 506 draw marking material that has been reloaded on the marking material-depleted regions 602 of the donor roll 302 after the donor roll has made a single rotation. Therefore, the marking material-depleted regions 602 only pass by the magnetic brush 304 a single time before supplying marking material to the reload target patches 506.

To the contrary, the ideal target patches 504 draw marking material from regions 600 of the donor roll 302 that are between the marking material-depleted regions 602 and, therefore, draw marking material from regions 600 of the donor roll 302 that have passed by the magnetic brush 304 multiple times (at least twice) while the marking material-depleted regions 602 have only passed by the magnetic brush 304 a single time (single rotation of the donor roll 302). The ideal target patches 504 therefore draw marking material from regions 600 of the donor roll that could be considered to be fully reloaded (or ideally reloaded) since they have passed the magnetic brush 304 multiple times.

After transferring the marking material to the reload target patches 506 and the ideal target patches 504 on the photoreceptor 300, the embodiments herein evaluate the reload function of the donor roll 302 and the magnetic brush 304 by comparing characteristics of the marking material on the reload target patches 506 with marking material on the ideal target patches 504 as they exist on the photoreceptor 300 (as sensed by the sensor 212). This allows the embodiments herein to alter the printing image charge to maintain the reload function within a predetermined range.

Figure 7:
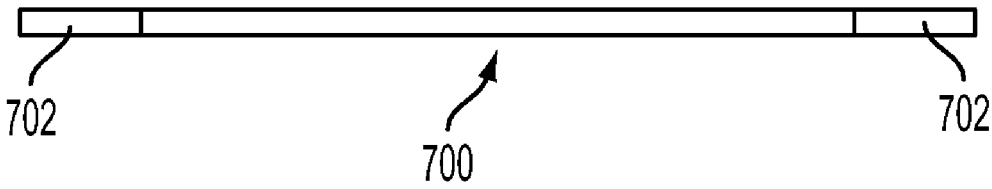
FIG. 7 is a top-view schematic diagram of a sensor according to embodiments herein.

More specifically, in item 114, the method evaluates and/or corrects the reload function of the donor roll 302 by calculating differences between the density of the developed target patches 504 and 506. For example, as shown in FIG. 7, a full width array (FWA) 700 sensor can be used to observe the developer material on the photoreceptor 400 or smaller separate sensors 702 that are only as wide as the non-printing areas 406 can be used. The method uses image based correction and, therefore, alters the printing image charge that is supplied to the printing regions 400 and the non-printing regions 402 of the photoreceptor 300 to maintain the reload function within a predetermined range, as show by item 116.

Figure 8:
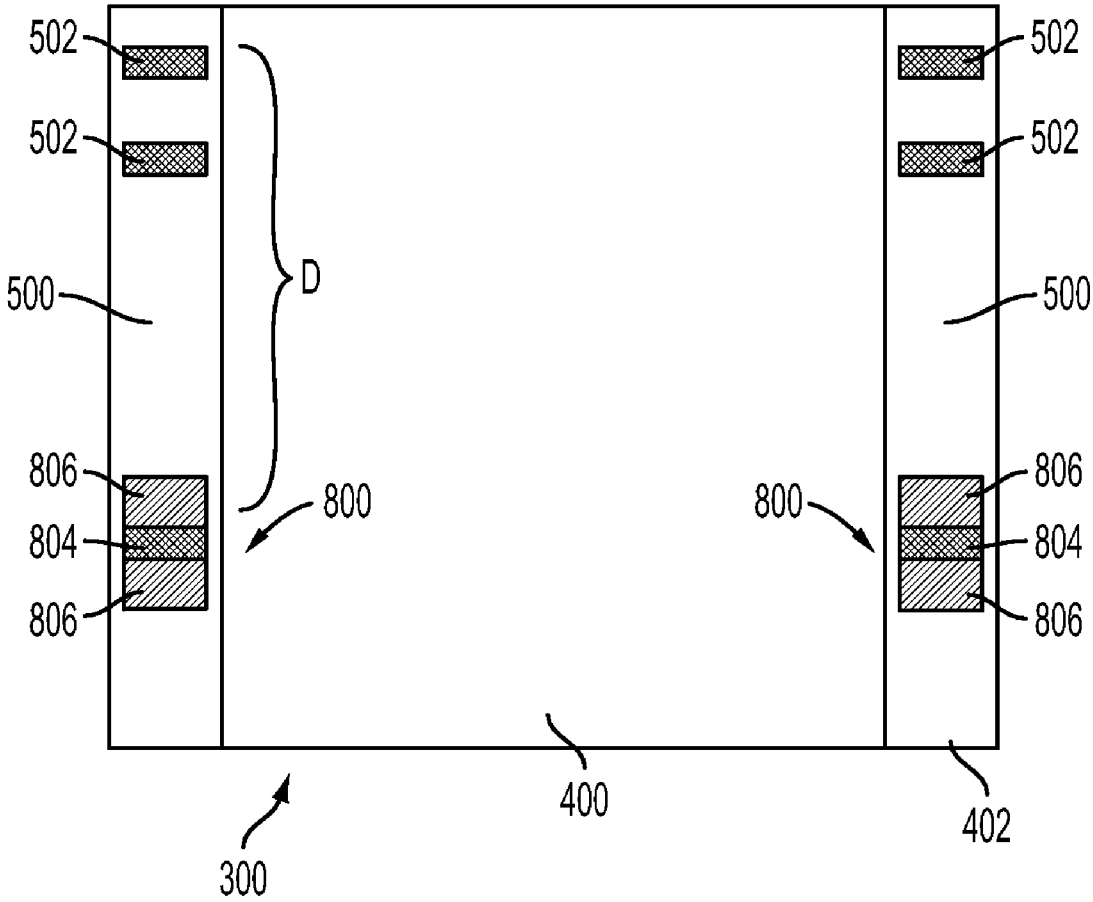
FIG. 8 is a top-view schematic diagram of a photoreceptor according to embodiments herein.

Also, as shown in FIG. 8, while the reload target patches 506 are shown as being completely separate from the ideal target patches 504 in FIG. 5, in other embodiments, the target patches can simply comprise an enlarged latently charged target patch area 800 that would be reloaded with marking material from both regions 600 and 602 of the donor roll 302. The regions 806 correspond to the reload target patches 506 and the regions 804 correspond to the ideal target patches 504. Again, the reload function is obtained from the measured difference of the marking material density between regions 806 and 804.

Thus, with embodiments herein patches are placed in the unused space outside of the customer image area to continually monitor the print engines reload performance during the customer print job. The reload source patches and reload target patches would be used to continually monitor reload performance across all source patch and target patch density ranges.

The toner on the photoreceptor is measured using, for example, the FWA scanbar 700 and the data is fed back to update the reload model for noise such as machine drift, changes in material state, environmental conditions changes, or anything that could change the reload performance.

Alternatively, similar measurements could be made during a calibration operation that occurs when customer print jobs are not being processed. Such donor calibration period reload function calculations could use the full width of the photoreceptor 400 and would not be limited to the non-printing areas 402. Such measurements/calculations could only be performed when customer jobs were not printing. However, such reload functions produced may not be current with the actual reload performance that may be changing as various print jobs are being processed, and would need to be periodically updated.

In another alternate embodiment, information on reload performance can be used to adjust developer housing setpoints for optimal life, image noise etc. For example, if the reload performance exceeds the specification, the magnetic roll could be slowed until the performance meets specification. Running at slower magnetic roll speeds would improve developer life. Alternately, setpoints could be adjusted for improving mottle by lowering the AC bias in the donor loading nip (Vdmac). Similarly, if the reload performance is below specification, the TC target may be adjusted. These setpoint adjustments may be made on a continual basis to ensure optimal performance.

The predetermined range of the reload function prevents ghost images from being formed within printed sheets 410 produced by the printing apparatus 200. The method alters the printing image to maintain the reload function within the predetermined range (114) yet avoids altering the relative rotational speeds of the donor roll 302 and the magnetic brush 304, the packing fraction of developer material, and/or the developer material concentration. In other words, in some embodiments, the method alters only the printing image (image based correction) to maintain the reload function within the predetermined range (114) which is substantially more efficient than methods that alter aspects relating to the physical loading of developer material on the donor roll 302.

This method constantly monitors the reload function of the developer material donor roll 302 while the print job is printing (item 116) on the media 410 to avoid the formation of ghost images on the printed product as shown by the flow arrows looping back from the reload function 114 to item 104 in the flowchart shown in FIG. 1. Thus, the "evaluating" of the reload function 114 and the "altering" of the printing image 104 occur simultaneously with the printing apparatus printing one or more print jobs, and the evaluating (114) and the altering (104) processes avoid interrupting the output of the print jobs 116.

An engine response curve (ERC) model for each cyan, magenta, yellow, black (CMYK) separation is used to alter the printing charge in item 110. An image buffer stores the reload source image for one (or more) donor roll revolution worth of the previous images, which are continuously refreshed. A compensation algorithm uses the printer reload model, the ERC model and the reload source level to correct the contone levels of the image. The printer reload model and ERC model are continuously updated to account for changes in developer material states, environment, etc.

FIGS. 9-17, discussed in the following portion of this application illustrate some aspects about reload and explain how the embodiments herein provide superior results over conventional systems. Reload defects occur due to mass or charge differences in the reloaded regions of the donor roll compared to the fully loaded regions of the donor roll. Both these differences manifest themselves as voltage differences of the toner layer which modulate the development electric field.

Figure 9:
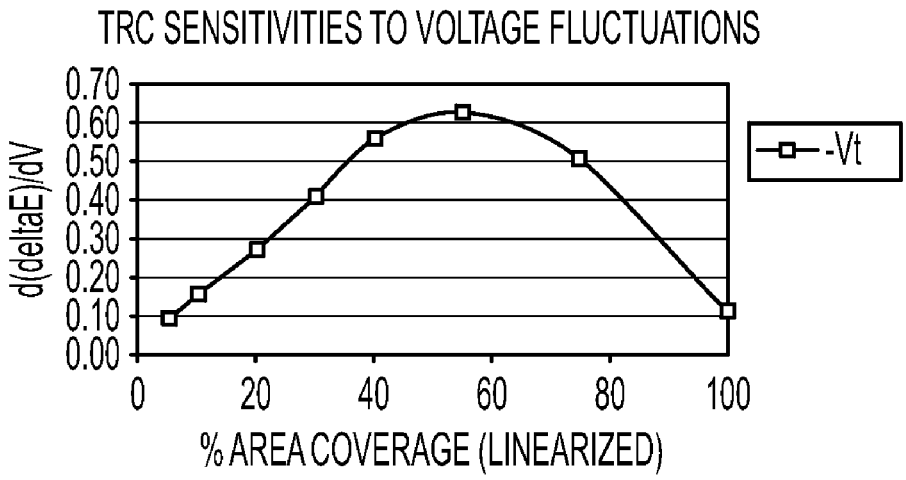
FIG. 9 is a diagram shows the effect of toner voltage differences according to embodiments herein.

FIG. 9 shows the effect of toner voltage differences on the TRC (tone reproduction curve). As shown in FIG. 9, mid tones are most sensitive to reload, while highlights and solids are less sensitive. In extreme cases when reloaded regions are supply limited, solid areas may be impacted as well.

Figure 10:
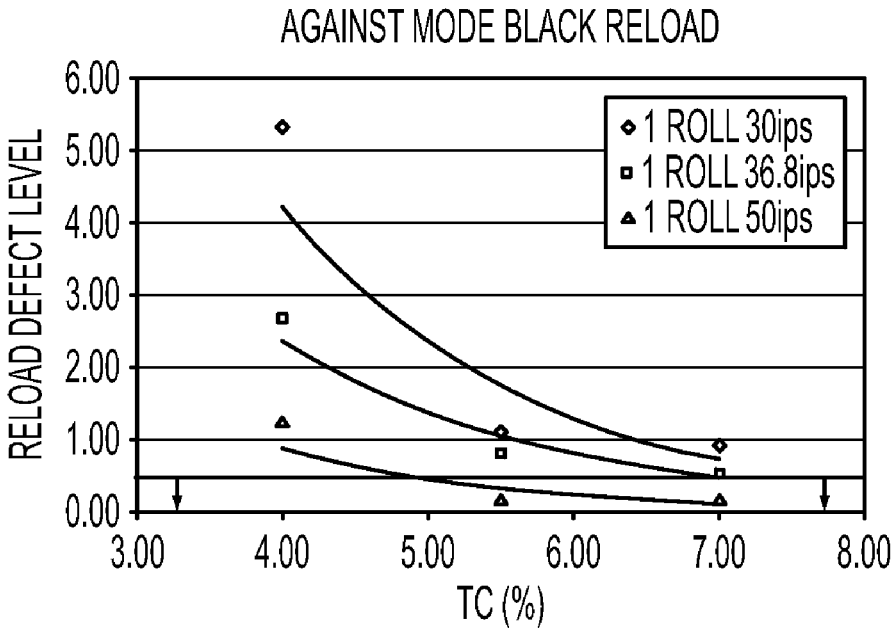
FIG. 10 is a diagram showing comparison of reload defect in against mode for black according to embodiments herein.
Figure 11:
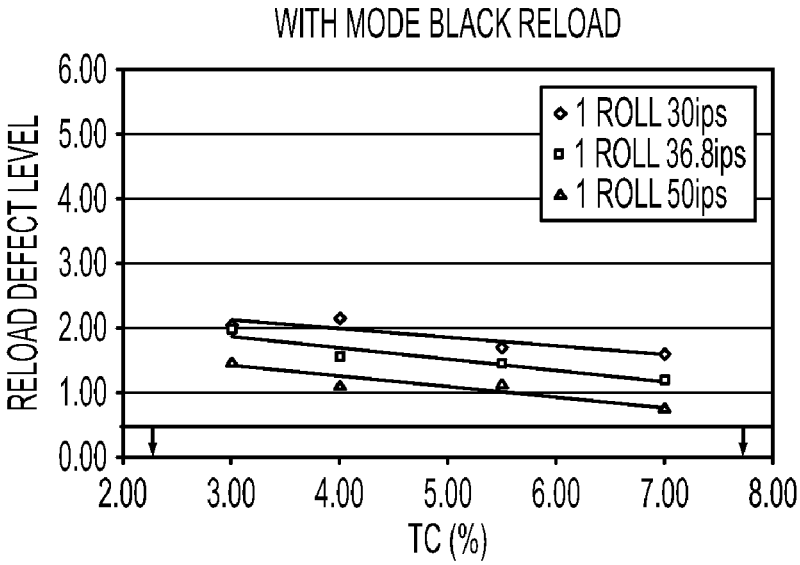
FIG. 11 is a diagram showing comparison of reload defect in with mode for black according to embodiments herein.
Figure 12:
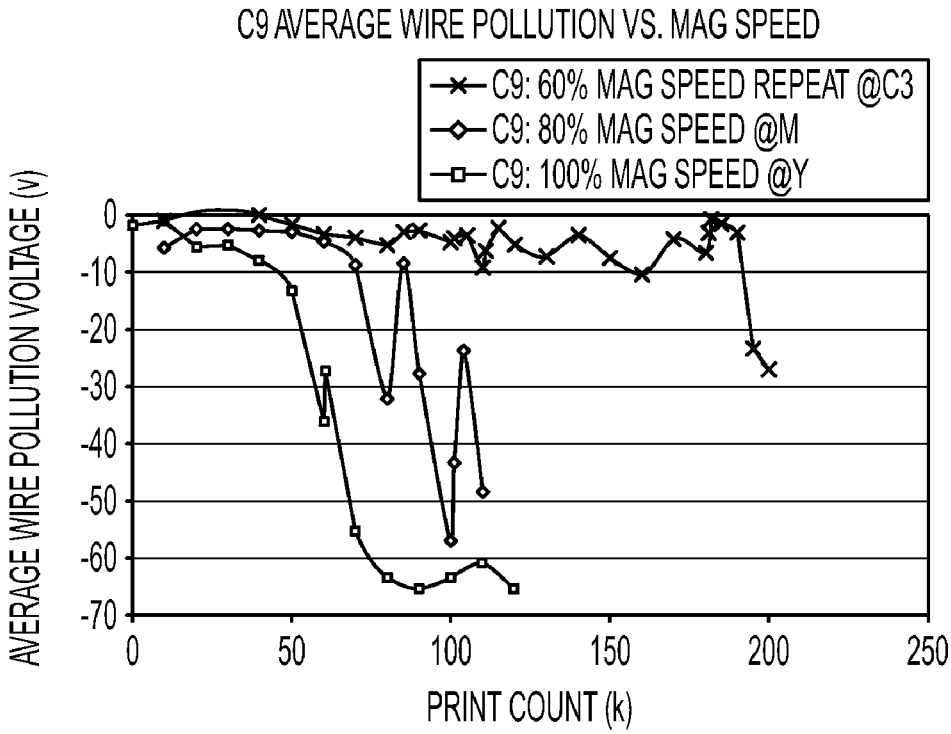
FIG. 12 is a diagram showing developer material abuse as a function of magnetic roll speed according to embodiments herein.
Figure 13:
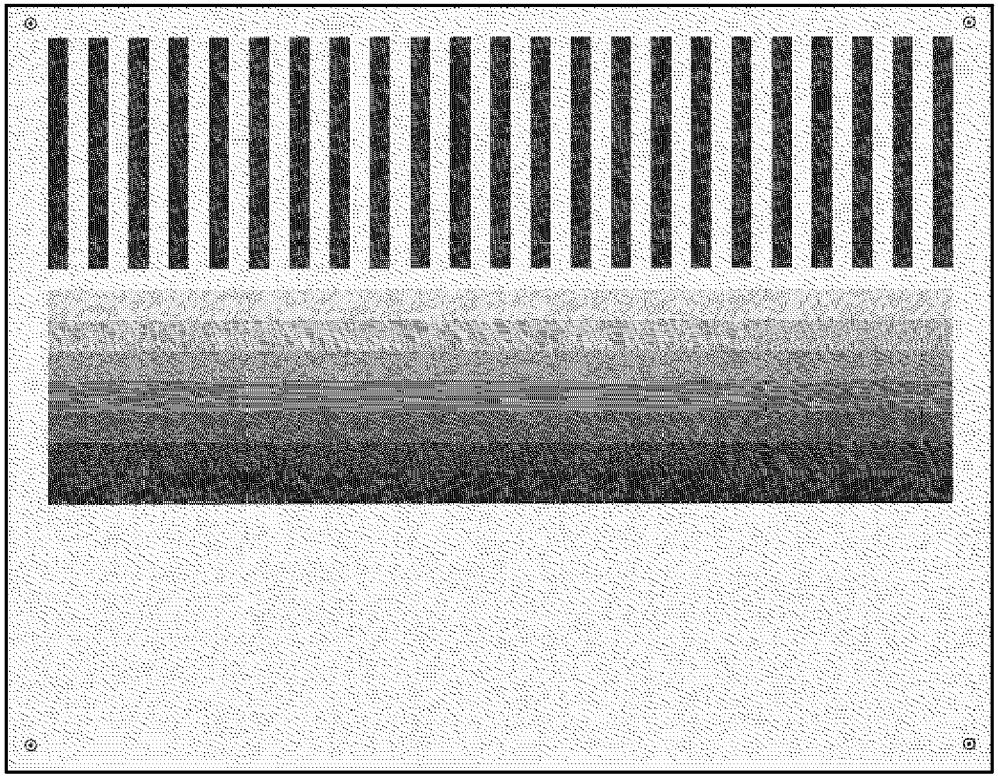
FIG. 13 is a diagram showing reload model calibration image according to embodiments herein.

In general, to decrease the reload defect, the supply of toner to the loading nip can be increased. This can be done via increasing the speed of the magnetic roll ($U_{mag}$), increasing the packing fraction of developer material in the loading zone (=Mass_On_Roll/Donor_Roll_Spacing), or increasing the toner concentration (TC). FIGS. 10 and 11 show plots for reload defect for two cases.

In FIG. 10, the donor rolls 302 are rotating in the same direction as the magnetic brush 304 so that the surfaces are moving opposite one another (i.e. "against" mode loading, which is sometimes referred to herein as the "opposite surface movement mode"). To the contrary, in FIG. 11, the donor rolls 302 are rotating in an opposite direction to the magnetic brush 304 so that the surfaces are moving in the same direction ("with" mode loading, which is sometimes referred to herein as the "same surface movement mode") as a function of $U_{mag}$ and TC.

The bottom dotted line in FIGS. 10 and 11 represents the desired specification. In this example, the printer operates in the opposite surface movement mode at a $U_{mag}$ of 50 ips which appears to meet at specification except at low TCs. For the same surface movement mode, the reload defect level does not meet the specification even at $U_{mag}$=50 ips. Note that the data in FIGS. 10 and 11 is for black which represents a stress case for reload.

Mottle is another important PQ (product quality) metric which has significant contribution from the development system. It has been observed that operating in the same surface movement mode improves mottle substantially at the expense of reload. In the opposite surface movement mode, loading is configured for good reload performance at the expense of mottle.

Yet another consideration is developer life. Development stability degrades as the developer material ages, leading to railed actuators and PQ failures such as streaks and mottle. The material abuse rate is a strong function of the magnetic roll speed. In fact it has been shown that by slowing the magnetic roll, the developer life can be extended (See FIG. 12). However, slowing the magnetic roll has a detrimental effect on reload as shown in FIGS. 10 and 11.

The battle between reload, mottle and developer life will only get more contentious at higher process speeds. At higher process speeds, reload will get worse unless the magnetic roll speed is increased. However, developer life is expected to suffer if magnetic roll speed is increased.

In embodiments herein, the method compensates for reload by manipulating the image as opposed to changing roller speeds, sizes or directions. IBC (image based controls) can be used to correct for one-dimensional defects such as streaks, harmonic strobing, etc, as well as two-dimensional defects such as photoreceptor ghosting. This approach is taken by embodiments herein to compensate for reload.

The following illustrates one example of a printer reload model according to embodiments herein. The first step is to obtain a reload model for the printer. This can be done by printing a series of calibration images (FIG. 13) where the reload of a source of area coverage sAC (0 to 100%) is measured on a target of area coverage tAC (0 to 100%) located at a distance of $\pi D_d U_{pr}/U_d$. The images can be captured on an FWA or a smaller sensor and analyzed using scripts to obtain a reload model R (sAC,tAC).

Figure 14:
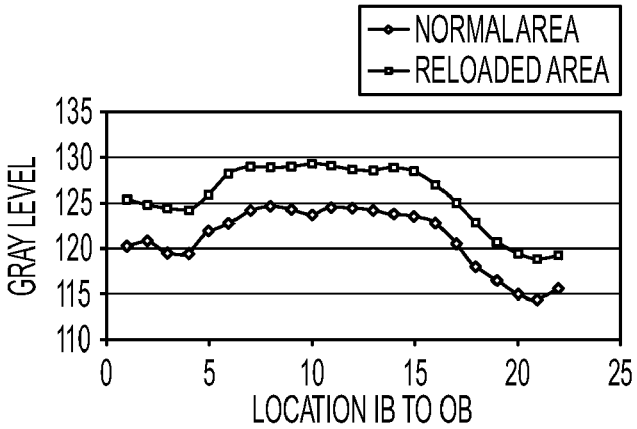
FIG. 14 is a diagram showing reload measurements according to embodiments herein.
Figure 15:
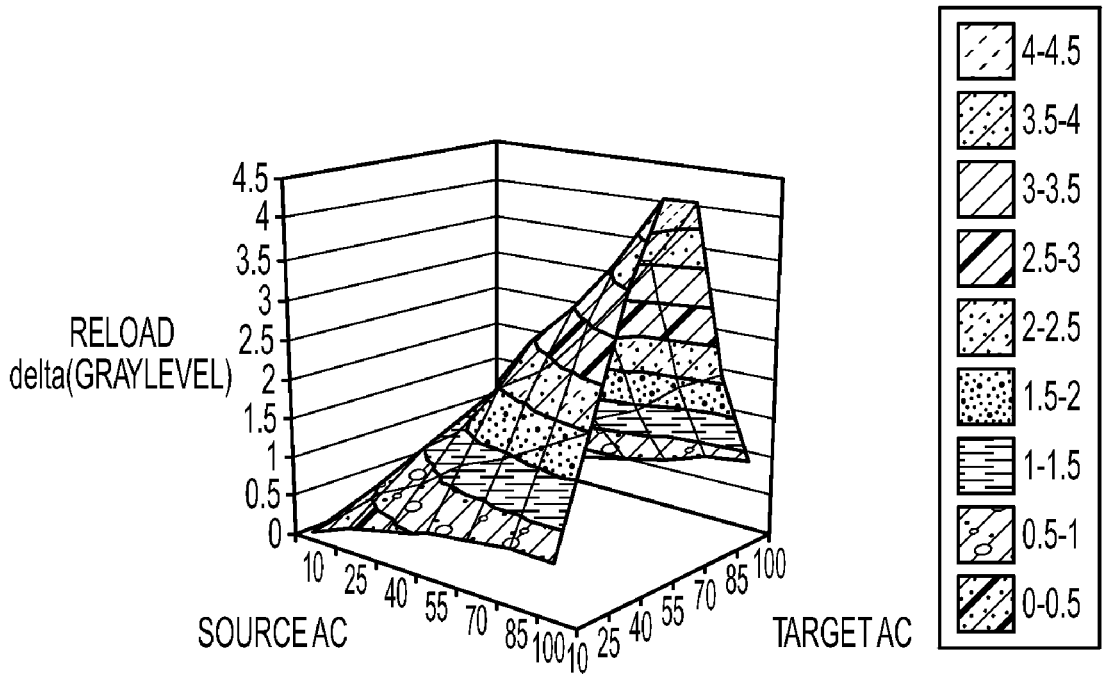
FIG. 15 is a diagram showing measured reload defect as a function of source and target area coverage according to embodiments herein.

FIG. 14 shows an example measured halftone gray levels for normal areas and reloaded areas of the image for sAC=100% and tAC=55%. The difference is the reload defect. There is a small spatial variation in the defect inboard (IB) to outboard (OB). This can be accounted for by building spatially varying reload models, which will result in more accurate compensation. FIG. 15 shows the average (IB to OB) reload data as a function of sAC and tAC. The reload data is fit into the following model:

$$R(\text{sAC},\text{tAC})=\text{sAC}*\text{tAC}(a_0+a_1\text{tAC}+a_2\text{tAC}^2+a_3\text{tAC}^3) \quad (1)$$

where $a_0$,$a_1$,$a_2$ and $a_3$ are obtained using least squares fit. Similar reload models can be constructed for sources at a distance of >1 donor revolution away. This discussion will focus only on reload due to source one donor revolution away, which is the dominant source of the defect.

With respect to image based compensation of reload defects, let the contone tone reproduction curve be represented by $x_{out}=\text{ERC}(x_{in})$ where $x_{in}$ is the input greylevel (specified in the image) $x_{out}$ is the output grey level (as measured by the FWA). The TRC can be measured using the same test patterns used to obtain the ghost image.

Figure 16:
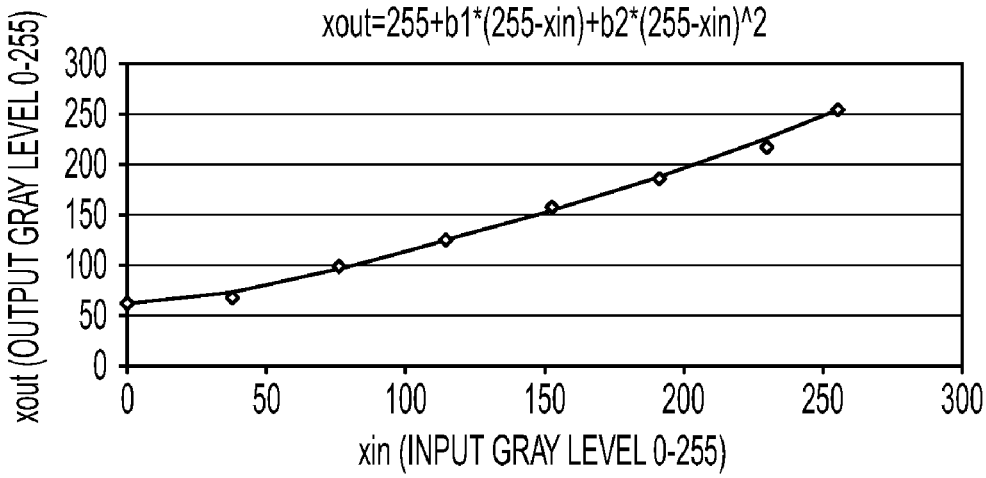
FIG. 16 is a diagram showing Contone ERC according to embodiments herein.
Figure 17:
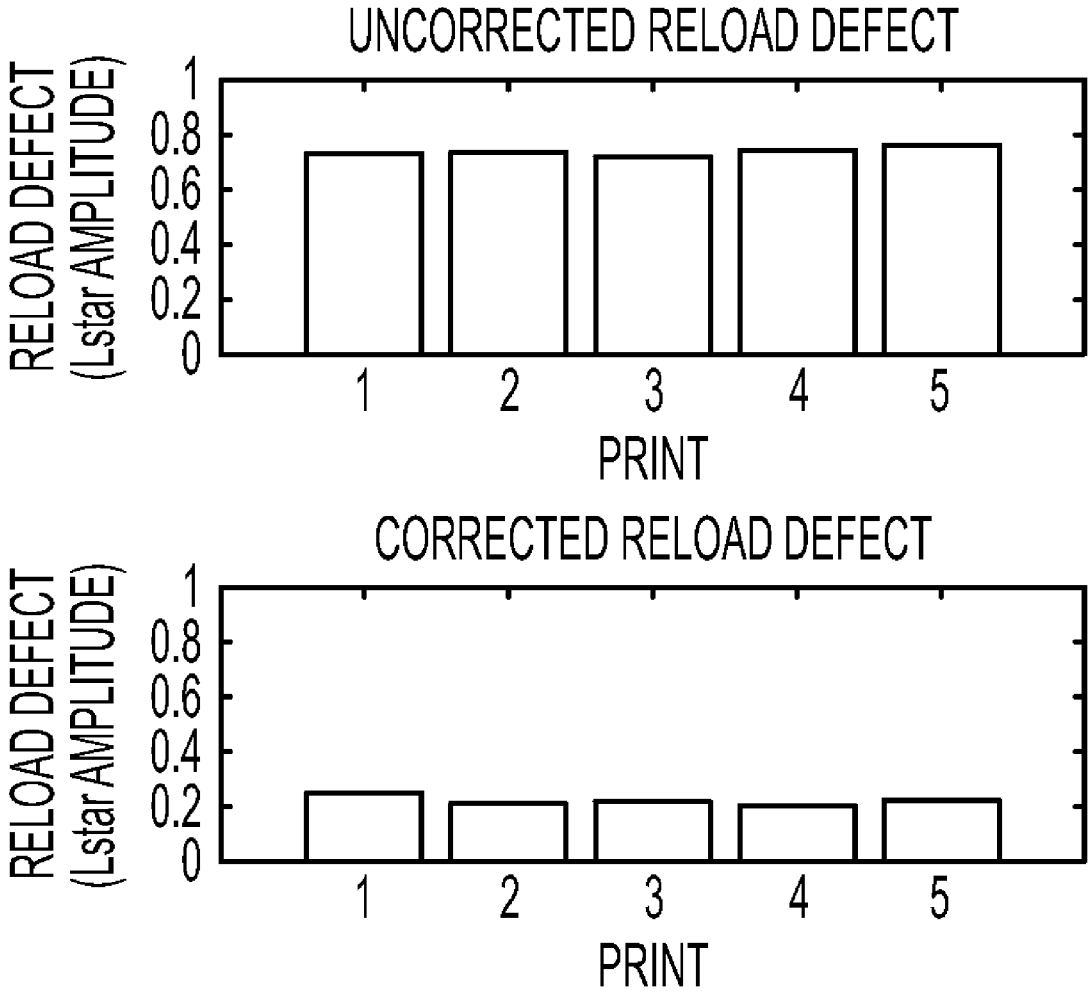
FIG. 17 shows the reload defect measured for the corrected and uncorrected prints according to embodiments herein.

FIG. 16 shows a measured ERC for a printer. The reload defect is caused by variations in the tone reproduction curve due to a source image located one (and more) donor revolution away. In the normal areas $$t_{out}=\text{ERC}(t_{in}) \quad (2)$$

and in reloaded areas $$t_{out}^{r}=\text{ERC}^{r}(t_{in},s_{in}) \quad (3)$$

where $\text{ERC}^r$ is the engine response curve of reloaded regions. Thus, the reload defect is given by $$R(t_{in},s_{in})=t_{out}^{r}-t_{out}=\text{ERC}^{r}(t_{in},s_{in})-\text{ERC}(t_{in}). \quad (4)$$

The embodiments herein adjust the input grey level $t_{in}$ by $\Delta t_{in}$ such that $$\begin{aligned} ERC(t_{in}) &= ERC^{r}(t_{in}+\Delta t_{in}, s_{in}) \\ &= R(t_{in}+\Delta t_{in}, s_{in}) + ERC(t_{in}+\Delta t_{in}) \\ &\approx R(t_{in}, s_{in}) + \frac{\partial R}{\partial t_{in}}\Delta t_{in} + ERC(t_{in}) + \frac{\partial ERC}{\partial t_{in}}\Delta t_{in} \end{aligned} \quad (5)$$

or $$\Delta t_{in} \approx -\frac{R(t_{in}, s_{in})}{\frac{\partial ERC}{\partial t_{in}} + \frac{\partial R}{\partial t_{in}}}. \quad (6)$$

The above equation can be further simplified since in general, $$\frac{\partial R}{\partial t_{in}} << \frac{\partial ERC}{\partial t_{in}}.$$

Equation 6 describes a simple correction that may be applied to the contone grey level value of every pixel to compensate for the reload defect. Iteration may be required due to noisy measurements and changing system state. Equation 6 can easily be modified to include iteration using a simple integral control term driven by measured reload error as the iteration proceeds.

FIG. 16 shows the reload defect measured from prints in L* units for the uncorrected (top line) and corrected prints (bottom line). The method shows considerable improvement after applying the correction. The prints after the correction were well within the spec for Cyan (0.3 L*units) while the uncorrected prints did not meet the specs.

Figure 18:
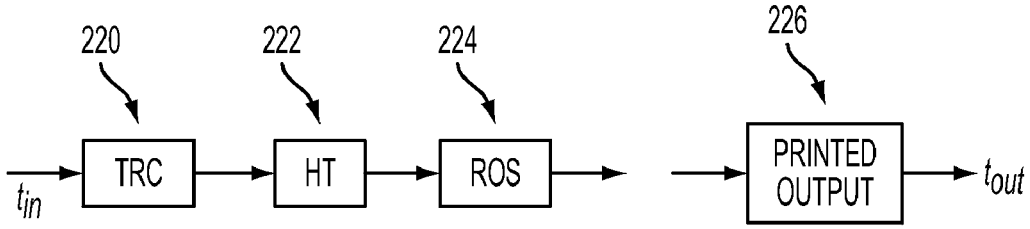
FIG. 18 is a diagram of a typical image path according to embodiments herein.
Figure 19:
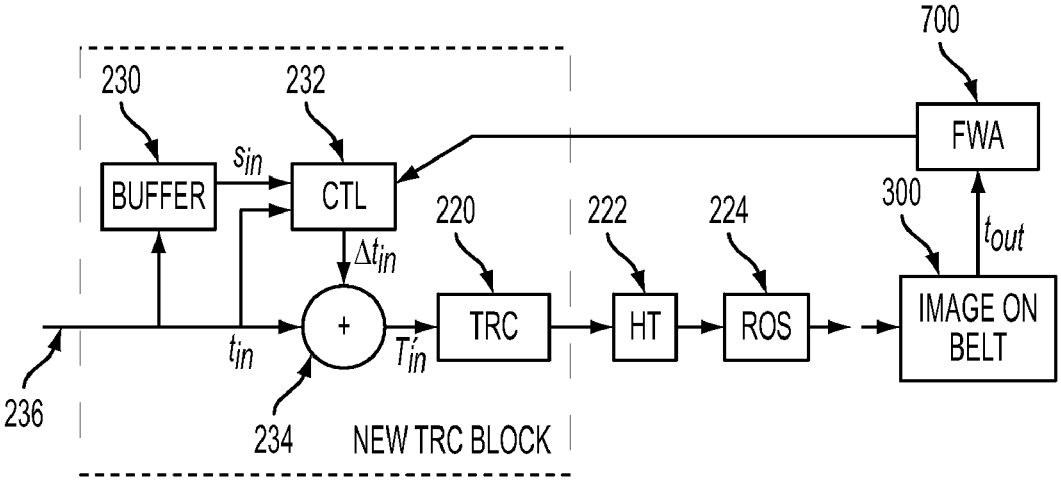
FIG. 19 is a diagram of an image path for reload compensation according to embodiments herein.

FIG. 18 shows a typical image path for an electrostatic engine and FIG. 19 shows an embodiment of a modified image path for reload compensation. More specifically, in FIG. 18 item 220 is a tone reproduction curve (TRC) generator which outputs a grey level to item 222, the halftone (HT) generator. Item 224 is a raster output scanner (ROS), which uses output from the halftone generator 222 to produce an image on the photoreceptor which is eventually formed on item 226, the printed output.

In FIG. 19, an output gray level $t_{out}$ is sensed by the FWA scanner 700 from the photoreceptor 300 and transferred to a controller (CTL) 232. The controller 232 calculates a correction factor $\Delta t_{in}$ and supplies the same to a summing block 234. The original input gray level $t_{in}$ is also input into the summing block 708. The summing block 234 outputs a corrected input gray level $t'_{in}$. The corrected input gray level $t'_{in}$ is then input into a tone reproduction curve (TRC) module 220. The input gray levels $t_{in}$ are also input into a buffer 230 which can store data from a number of scanlines at least equal to the number of scanlines in one complete photoreceptor revolution.

Reload source input gray levels $S_{in}$ are output from the buffer 230 to the controller 232. The target input gray level 236 is also input to the controller 232. The controller 232 uses the input gray level 602, the reload source input gray level $S_{in}$ and the output gray level $t_{out}$ in calculating the correction factor $\Delta t_{in}$. The TRC block 220 is modified with embodiments herein to accommodate the adjustments required to compensate for the reload effects. Note that the modification is on a pixel basis. This modification can be made anywhere upstream of the traditional TRC block 220.

The word "printer" or "image output terminal" as used herein encompasses any apparatus, such as a digital copier, bookmaking machine, facsimile machine, multi-function machine, etc. which performs a print outputting function for any purpose. The embodiments herein specifically applied to electrostatic and xerographic devices. The details of printers, printing engines, etc. are well-known by those ordinarily skilled in the art and are discussed in, for example, U.S. Pat. No. 6,032,004, the complete disclosure of which is fully incorporated herein by reference.

Figure 20:
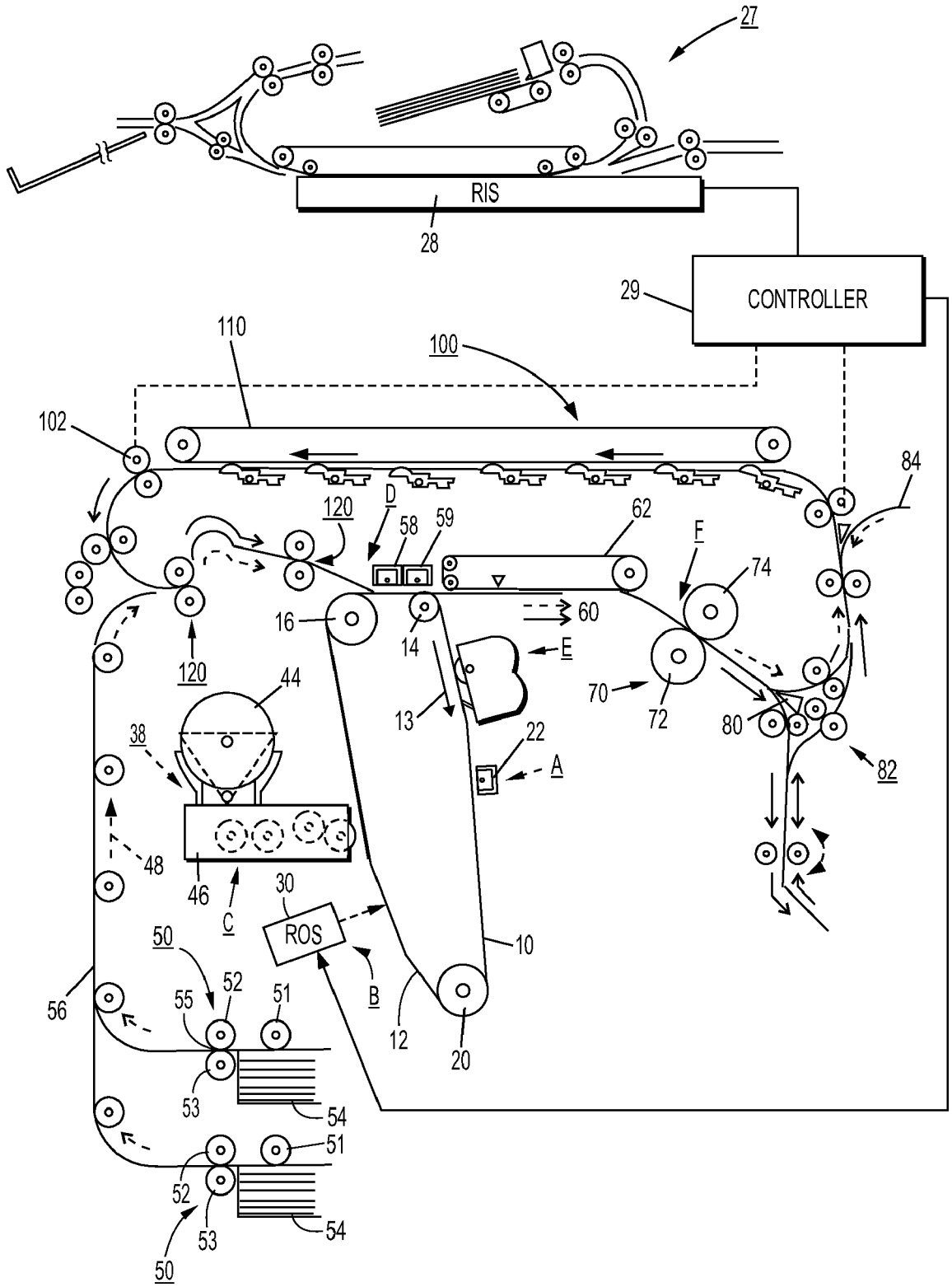
FIG. 20 is a cross-sectional schematic diagram of a printing device according to embodiments herein.

For example, FIG. 20 schematically depicts an electrophotographic printing machine that is similar to one described in U.S. Pat. No. 6,032,004. It will become evident from the following discussion that the present embodiments may be employed in a wide variety of devices and is not specifically limited in its application to the particular embodiment depicted in FIG. 20. Referring to FIG. 20, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 20 schematically illustrates an electrophotographic printing machine which generally employs a photoconductive belt 10. The photoconductive belt 10 can be made from a photoconductive material coated on a ground layer, which, in turn, can be coated on an anti-curl backing layer. Belt 10 moves in the direction of arrow 13 to advance successive portions sequentially through the various processing stations disposed about the path of movement thereof. Belt 10 can be entrained about stripping roller 14, tensioning roller 16 and drive roller 20. As roller 20 rotates, it advances belt 10 in the direction of arrow 13. Tensioning roller 16 is designed according to equation (2), can be biased, and provides the same motion control that is discussed above with respect to rollers 103 and 310.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which can be transmitted to a modulated output generator, for example the raster output scanner (ROS), indicated generally by reference numeral 30. The ESS 29 can be a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 20, after the electrostatic latent image is developed, the toner powder image present on belt 10 advances to transfer station D. A print sheet 48 can be advanced to the transfer station, D, by a sheet feeding apparatus, 50. The sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. The fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll can be internally heated by a quartz lamp (not shown). Release agent, stored in a reservoir (not shown), can be pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller 29 can be a programmable microprocessor which controls all machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock, Tex., USA, and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The word "printer" or "image output terminal" as used herein encompasses any apparatus, such as a digital copier, bookmaking machine, facsimile machine, multi-function machine, etc. which performs a print outputting function for any purpose. The embodiments herein can encompass embodiments that print in color, monochrome, or handle color or monochrome image data. All foregoing embodiments are specifically applicable to electrostatographic and/or xerographic machines and/or processes.

Thus, as mentioned above, mottle and reload image quality defects are important to the customer and are very difficult to improve, primarily due to the strong interaction between the two. For example, when the donor rolls are run against the magnetic brush, reload is virtually undetectable while mottle is very noticeable. However, when the donor rolls are run with the magnetic brush the mottle performance is much improved while the reload performance is unacceptable. As toner ages the mottle performance degrades while the reload performance improves and as the toner concentration increases the reload performance improves while the mottle performance degrades. To solve this problem mottle and reload have been decoupled by the embodiments herein. More specifically, by only altering the manner in which the image charge is applied and not altering the physical structure used to apply the toner, the embodiments herein achieve high reload performance without experiencing mottle.

Thus, embodiments herein provide a way to mitigate or eliminate reload defects in hybrid development systems using image based compensation. Embodiments herein address primarily halftone reload. Solid area reload can be simultaneously addressed by changes in developer setpoints such as the TC, relative speeds of donor roll and magnetic brush. The embodiments herein open up design latitude for hybrid development systems, where these systems can now be optimized for high developer life through low speed magnetic rolls, low image noise through roll directions and insulative developer materials. Such optimization was not possible previously because the need to achieve acceptable reload required specific choices of developer housing parameters (magnetic roll speeds and donor directions) and developer material parameters (conductive).

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. A method comprising:

charging latent images of source patches on a photoreceptor printing region;

transferring marking material from a donor roll to said photoreceptor, said source patches causing marking material to be removed from areas of said donor roll to create marking material-depleted regions corresponding to said source patches and leaving ideal regions on said donor roll between said marking material-depleted regions, said ideal regions being positioned where no marking material is removed by said source patches;

reloading said marking material-depleted regions with marking material using a magnetic brush to create reloaded regions on said donor roll;

charging latent images of reload target patches and ideal target patches on said photoreceptor printing region, said reload target patches being located on said photoreceptor one donor roll circumference from said source patches, and said ideal target patches being located on said photoreceptor between said reload target patches;

continuing said transferring of said marking material from said donor roll to said photoreceptor to transfer said marking material from said reloaded regions to said reload target patches and from said ideal regions to said ideal target patches;

evaluating a reload function of said donor roll and said magnetic brush by comparing characteristics of said marking material on said reload target patches with marking material on said ideal target patches; and altering a printing image charge to maintain said reload function within a predetermined range.

2. The method according to claim 1, said altering of said printing charge to maintain said reload function within said predetermined range, avoids altering any of:

relative rotational speeds of said donor roll and said magnetic brush;

packing fraction of marking material; and marking material concentration.

3. The method according to claim 1, said altering comprising image based corrections.

4. The method according to claim 1, said reload function evaluated at the photoreceptor printing image area of the photoreceptor to allow for 2D spatial correction.

5. The method according to claim 1, said method being performed during a calibration operation of a printing apparatus that can be performed in-line or off-line.

6. A method comprising:

creating a latent printing image charge on a photoreceptor printing region of a photoreceptor within a printing apparatus;

simultaneously with said creating of said printing image charge, charging latent images of source patches on a non-printing region of said photoreceptor outside said photoreceptor printing region;

transferring marking material from a donor roll to said photoreceptor by rotating said donor roll as said photoreceptor passes by said donor roll, said source patches causing marking material to be removed from areas of said donor roll outside a donor roll printing region to create marking material-depleted regions corresponding to said source patches and leaving ideal regions on said donor roll between said marking material-depleted regions, said ideal regions being positioned where no marking material is removed by said source patches;

reloading said marking material-depleted regions with marking material using a magnetic brush to create reloaded regions on said donor roll;

after said reloading of said marking material-depleted regions, and simultaneously with said creating of said printing image charge, charging latent images of reload target patches and ideal target patches on said non-printing region of said photoreceptor, said reload target patches being located one donor roll circumference on said photoreceptor from said source patches, and said ideal target patches being located on said photoreceptor between said reload target patches;

continuing said transferring of said marking material from said donor roll to said photoreceptor to transfer said marking material from said reloaded regions to said reload target patches and from said ideal regions to said ideal target patches;

after transferring said marking material to said reload target patches and said ideal target patches on said photoreceptor, evaluating a reload function of said donor roll and said magnetic brush by comparing characteristics of said marking material on said reload target patches with marking material on said ideal target patches; and altering said printing image charge and reload target image charge to maintain said reload function within a predetermined range.

7. The method according to claim 6, said altering of said printing charge to maintain said reload function within said predetermined range, avoids altering any of:

relative rotational speeds of said donor roll and said magnetic brush;

packing fraction of marking material; and marking material concentration.

8. The method according to claim 6, said altering comprising image based corrections.

9. The method according to claim 6, further comprising dynamically choosing said source patches, said reload target patches, and said ideal target patches to have densities and colors based on said printing image.

10. The method according to claim 6, said method being performed during a calibration operation of said printing apparatus.

11. A printing device comprising:

a photoreceptor;

a raster image scanner writing latent images of source patches on a non-printing region of said photoreceptor outside a photoreceptor printing region;

a donor roll transferring marking material to said photoreceptor, said source patches causing marking material to be removed from areas of said donor roll outside a donor roll printing region to create marking material-depleted regions corresponding to said source patches and leaving ideal regions on said donor roll between said marking material-depleted regions, said ideal regions being positioned where no marking material is removed by said source patches;

a magnetic brush reloading said marking material-depleted regions with marking material to create reloaded regions on said donor roll;

a sensor scanning said non-printing region of said photoreceptor to output a scanned image of said marking material on said non-printing region of said photoreceptor; and a processor processing said scanned image, said raster image scanner writing latent images of reload target patches and ideal target patches on said non-printing region of said photoreceptor, said reload target patches being located one donor roll circumference on said photoreceptor from said source patches, and said ideal target patches being located on said photoreceptor between said reload target patches, said donor roll transferring said marking material from said donor roll to said photoreceptor to transfer said marking material from said reloaded regions to said reload target patches and from said ideal regions to said ideal target patches, said processor evaluating a reload function of said donor roll and said magnetic brush by comparing characteristics of said marking material on said reload target patches with marking material on said ideal target patches, and said processor altering a printing image charge to maintain said reload function within a predetermined range.

12. The printing device according to claim 11, said processor altering said printing charge to maintain said reload function within said predetermined range, avoids altering any of:

relative rotational speeds of said donor roll and said magnetic brush;

packing fraction of marking material; and marking material concentration.

13. The printing device according to claim 11, said altering performed by said processor comprising image based corrections.

14. The printing device according to claim 11, said processor dynamically choosing said source patches, said reload target patches, and said ideal target patches to have densities and colors based on said printing image charge.

15. The printing device according to claim 11, said altering performed by said processor comprising a calibration operation of said printing apparatus that can be performed in-line or off-line.

16. A computer program storage comprising:

a non-transitory computer-readable computer storage medium storing instructions that, when executed by a printing apparatus, cause the printing apparatus to perform a method comprising:

charging latent images of source patches on a non-printing region of said photoreceptor outside a photoreceptor printing region;

transferring marking material from a donor roll to said photoreceptor, said source patches causing marking material to be removed from areas of said donor roll outside a donor roll printing region to create marking material-depleted regions corresponding to said source patches and leaving ideal regions on said donor roll between said marking material-depleted regions, said ideal regions being positioned where no marking material is removed by said source patches;

reloading said marking material-depleted regions with marking material using a magnetic brush to create reloaded regions on said donor roll;

charging latent images of reload target patches and ideal target patches on said non-printing region of said photoreceptor, said reload target patches being located one donor roll circumference on said photoreceptor from said source patches, and said ideal target patches being located on said photoreceptor between said reload target patches;

continuing said transferring of said marking material from said donor roll to said photoreceptor to transfer said marking material from said reloaded regions to said reload target patches and from said ideal regions to said ideal target patches;

evaluating a reload function of said donor roll and said magnetic brush by comparing characteristics of said marking material on said reload target patches with marking material on said ideal target patches; and altering a printing image charge to maintain said reload function within a predetermined range.

17. The computer program storage according to claim 16, said altering of said printing charge to maintain said reload function within said predetermined range, avoids altering any of:

relative rotational speeds of said donor roll and said magnetic brush;

packing fraction of marking material; and marking material concentration.

18. The computer program storage according to claim 16, said altering comprising image based corrections.

19. The computer program storage according to claim 16, said method further comprising dynamically choosing said source patches, said reload target patches, and said ideal target patches to have densities and colors based on said printing image.

20. The computer program storage according to claim 16, said method being performed during a calibration operation of said printing apparatus that can be performed in-line or off-line.

* * * * *